US006381877B2

(12) United States Patent
Filice

(10) Patent No.: US 6,381,877 B2
(45) Date of Patent: May 7, 2002

(54) CONTROLLED FLEX SKATE BOOT

(75) Inventor: Gary W. Filice, Van Nuys, CA (US)

(73) Assignee: Jas D. Easton, Inc., Van Nuys, CA (US)

( * ) Notice: Subject to any disclaimer, the term of this patent is extended or adjusted under 35 U.S.C. 154(b) by 0 days.

(21) Appl. No.: 09/451,399

(22) Filed: Nov. 30, 1999

(51) Int. Cl.[7] ..... A43B 5/04; A43B 1/10; A43B 23/02

(52) U.S. Cl. ..... 36/115; 36/102; 36/109; 36/117.1; 36/118.2

(58) Field of Search ..... 36/115, 54, 102, 36/109, 117.1, 117.2, 118.2, 119.1, 131, 45, 50.5; 280/841, 11.12, 11.19, 809, 811

(56) References Cited

U.S. PATENT DOCUMENTS

| | | | | | |
|---|---|---|---|---|---|
| 746,338 | A | | 12/1903 | Keen | |
| 1,522,256 | A | | 1/1925 | Meyers | |
| 1,986,580 | A | * | 1/1935 | Johnson | 36/115 |
| 2,774,152 | A | | 12/1956 | Alber | |
| 2,942,359 | A | | 6/1960 | Bushway et al. | |
| 3,535,800 | A | * | 10/1970 | Stohr | 36/117.1 |
| 3,537,716 | A | | 11/1970 | Norgiel | |
| 3,906,645 | A | * | 9/1975 | Heckel | 36/131 |
| 3,988,842 | A | * | 11/1976 | Rathmell | 36/117.31 |
| 4,144,659 | A | | 3/1979 | Eisenberg | |
| 4,509,276 | A | | 4/1985 | Bourque | |
| 4,563,825 | A | * | 1/1986 | Tesser | 36/131 |
| 4,655,465 | A | | 4/1987 | Schaeffer | |
| 4,669,202 | A | * | 6/1987 | Ottieri | 36/54 |
| 4,724,627 | A | | 2/1988 | Sisco | |
| 4,835,885 | A | | 6/1989 | Hoshizaki | |
| 4,937,955 | A | | 7/1990 | Bonaventure | |
| 5,024,006 | A | * | 6/1991 | Kiyosawa | 36/54 |
| 5,086,575 | A | | 2/1992 | Bonaventure | |
| 5,357,695 | A | * | 10/1994 | Lu | 36/115 |
| 5,430,961 | A | | 7/1995 | Faulconer et al. | |
| 5,480,168 | A | * | 1/1996 | Chen | 36/115 |
| 5,498,033 | A | * | 3/1996 | Hoshizaki et al. | 36/115 |
| 5,503,412 | A | | 4/1996 | Hill | |
| 5,575,090 | A | | 11/1996 | Condini | |
| D383,513 | S | | 9/1997 | Ryan et al. | |
| D402,327 | S | | 12/1998 | Aird et al. | |
| 5,896,683 | A | | 4/1999 | Foxen et al. | |

FOREIGN PATENT DOCUMENTS

| | | | | |
|---|---|---|---|---|
| CA | 1066500 | * | 11/1979 | 36/115 |
| EP | 317798 | * | 5/1989 | 36/117.1 |
| EP | 556799 | * | 8/1993 | 36/118.2 |
| EP | 0 646 335 A1 | | 5/1995 | |
| GB | 1106958 | * | 3/1968 | 36/118.2 |

* cited by examiner

*Primary Examiner*—Anthony Stashick
(74) *Attorney, Agent, or Firm*—Roth & Goldman

(57) ABSTRACT

A flexible skate boot having lower and upper portions made of leather, synthetic leather or similar material is provided with a flexible ankle encircling cuff made of synthetic moldable plastic material capable flexing designed in amounts in the forward and aft and lateral directions to act as an energy storage and release device and without wrinkling so as to minimize discomfort and abrasion on the user's ankle and extend the useful life of the boot. The tongue portion of the boot has a similar molded synthetic flexible panel separating the upper and lower sections of the tongue, the tongue panel being aligned with the flexible ankle encircling cuff which separates the upper and lower parts of the boot from each other. The parts are designed to essentially lock the tongue in the desired frontal position to prevent tongue migration from the desired frontal position during skating. The foot confining portion of the boot can be hand formed of leather on a last for custom fit so that the boot can be used with minimal break in.

23 Claims, 4 Drawing Sheets

FIG. 7
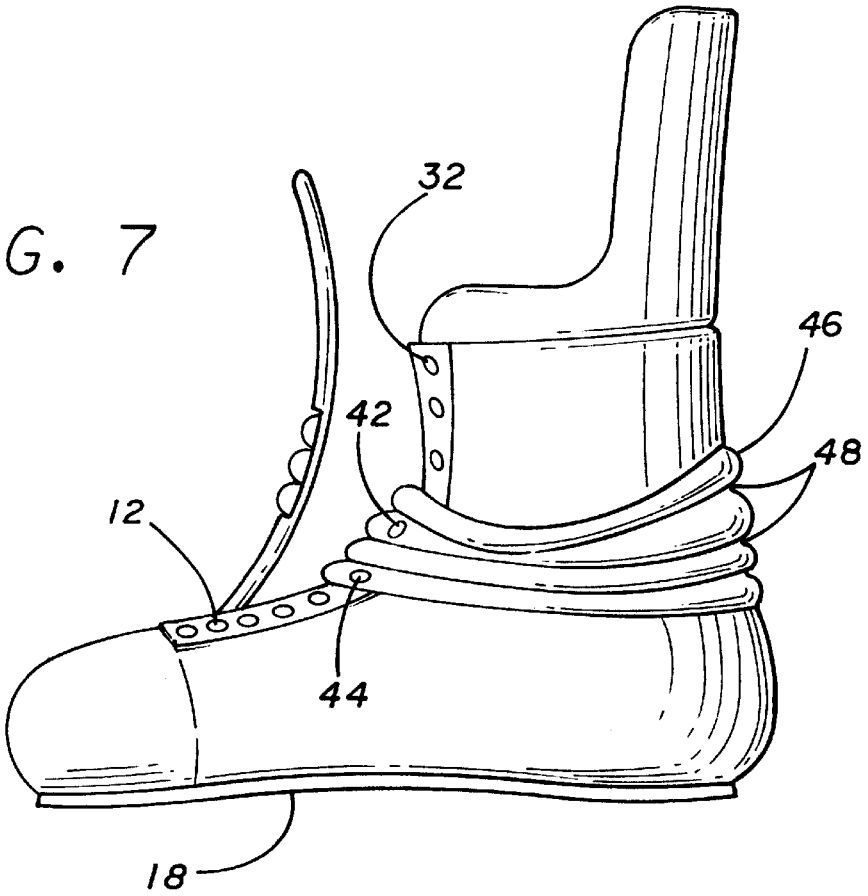
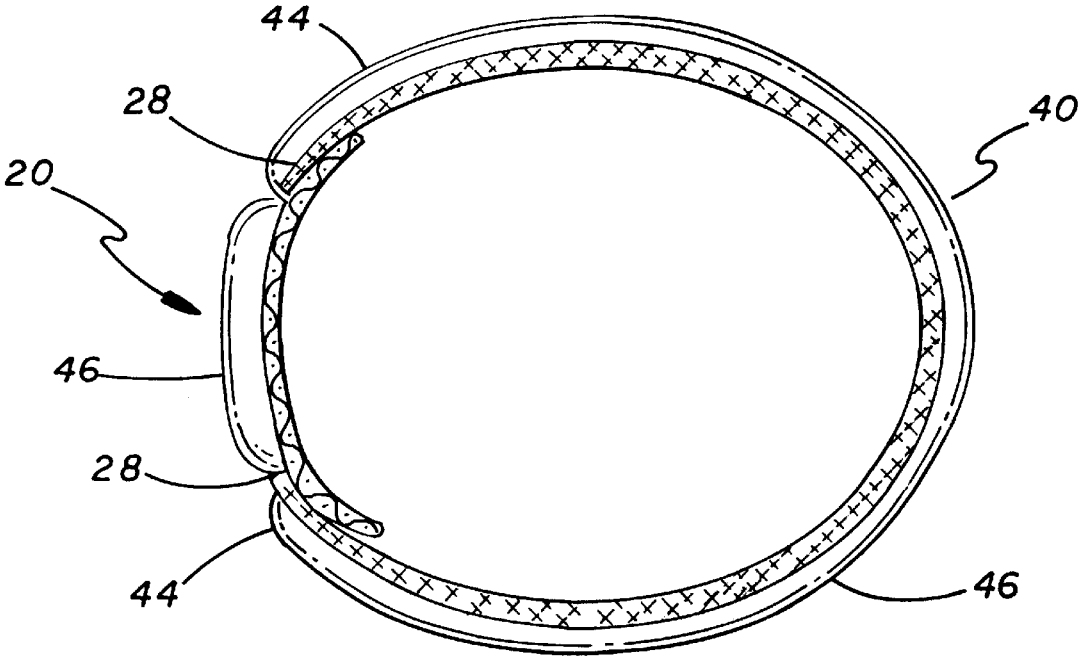
FIG. 8

CONTROLLED FLEX SKATE BOOT

The present invention relates to improvements in boots primarily intended for ice skating but equally to roller blade use and roller skating use since each of these sports generally requires lateral bending and straightening of the ankle when the skater imparts force to the skating surface during a skating stroke. It is well known that, particularly in skating at high levels such as in professional and high level amateur hockey, the skater's boot is repeatedly subjected to considerable stress and repeated flexing in a number of different direction, particularly in the ankle cuff area of the boot and in the tongue area of the boot.

PRIOR ART

The prior art is replete with various ice skate boots of leather, simulated leather and various plastics as shown for example in U.S. Pat. No. 4,835,885 issued Jun. 6, 1989 to Hosizaki et al. and U.S. Pat. No. 4,655,465 issued Apr. 7, 1987 to Schaeffer, each of which include various reinforcing panels affixed to the boot in areas subjected to substantial stress. Typically, the sections of the boots which are not subjected to substantial flexing are unreformed.

Since proper fit is considerably important for skaters to avoid slop or rubbing the skater's foot or ankle in use of the boot for strenuous sports such as hockey, many hockey boots, particularly for professional skaters, are hand formed of leather, synthetic leather and plastic on a last made to the precise size and shape of the particular skater's foot.

OBJECT OF THE INVENTION

It is accordingly the primary objective of the present invention to provide a boot having a lower foot confining section which may be last formed and an upper section, each of leather or synthetic leather or similar materials, with a flexible ankle cuff section made of different material which completely replaces portions of the boot shell and tongue in the areas they occupy.

SUMMARY OF THE INVENTION

The present invention provides a boot comprising an upper section and a lower foot confining section formed of leather or synthetic leather and a tongue connected to said foot confining section; an ankle cuff section joined to and spacing said lower section from said upper section; said ankle cuff section being constructed of synthetic material of equal or greater flexibility than said lower and said upper sections of said boot.

The present invention further provides a skate boot comprising a lower section including a sole for receiving a skate attachment and a relatively soft foot confining section; a tongue having a lower portion connected to said foot confining section, a central portion connected to said lower portion and an upper portion connected to said central portion; an upper leg section; an ankle cuff section joined to said upper section and said foot confining section; said central tongue portion comprising a flexible tongue section adjacent said ankle cuff section; said ankle cuff section being of equal or greater flexibility than said lower and said upper sections of said boot. Such a boot may be made of leather or synthetic leather and custom formed by hand on a last to closely fit a skater's precise foot dimensions so that the boot will quickly perform as if it had already been broken in. Since flexing primarily takes place in the flexible ankle and tongue portions, the boot continues to perform well beyond the break in period ordinarily experienced when using new skate boots due to reduced degradation of the leather or simulated leather sections of the boot.

BRIEF DESCRIPTION OF THE DRAWINGS

FIG. 7 is a side elevation view of a boot constructed according to the teachings of the present invention with a modified configuration of flexible ankle cuff panel between the lower and upper boot sections.

FIG. 8 is a across sectional plan view showing the flexible ankle cuff section and its engagement with the flexible tongue panel.

DESCRIPTION OF THE PREFERRED EMBODIMENTS

Figure 1:
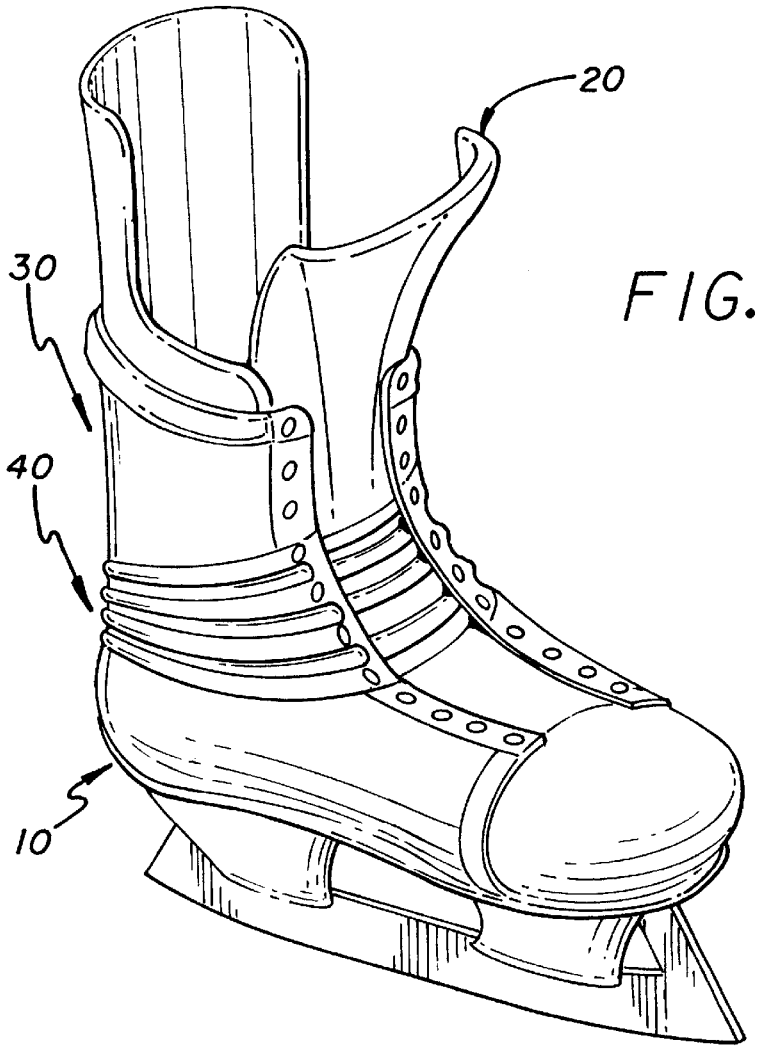
FIG. 1 is a perspective view of a boot constructed according to the teachings of the present invention with ice skate blade attached thereto.

The skate boot of the present invention, seen in perspective view in FIG. 1, is comprised of a lower foot confining section 10, a tongue 20 connected to the lower foot confining section of the boot, an upper leg confining section or shank 30 and, particularly pursuant to the present invention, an ankle cuff section 40 interposed between and generally interconnecting the lower foot confining section 10 and the upper leg confining section 30. Similarly, the tongue 20 preferably has a flexible tongue section 26 joined to lower and upper tongue portions 22, 24, the flexible tongue section 26 being adjacent to and essentially aligning with the flexible ankle cuff section 40 to completely encircle the skater's ankle. Unlike the upper and lower sections 10, 30 of the boot which are constructed of leather or synthetic leather which may be worked by hand and formed on a last to the skater's precise foot dimensions, the ankle cuff section 40 and the flexible tongue section 26 each are constructed of plastic materials such as urethane or polyester which may be configured in molds and designed to provide controllable equal or greater flexibility in desired directions than the lower or the upper sections 10, 30 of the boot and the upper and lower parts 22, 24 of the tongue.

Not unlike prior art boots, the boot of the present invention further includes two spaced rows of lace eyelets along the front of the boot proximate the tongue 20. The lace eyelets 12 in the lower section of the boot and the lace eyelets 32 in the upper section of the boot may extend through spaced eyelet reinforcing bands 16, 36 in the lower and upper sections of the boot respectively. Lace eyelets 42 also extend through the flexible ankle cuff section 40 as shown but it will be noted that the reinforcing bands 16, 36 are absent in the flexible cuff section 40 so as not to interfere with the designed in flexibility and directional flexure characteristics of the cuff section 40.

Figure 4A:
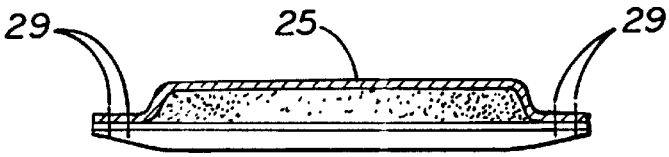
FIG. 4A is a cross section of the tongue taken at Line A—A on FIG. 4.
Figure 4:
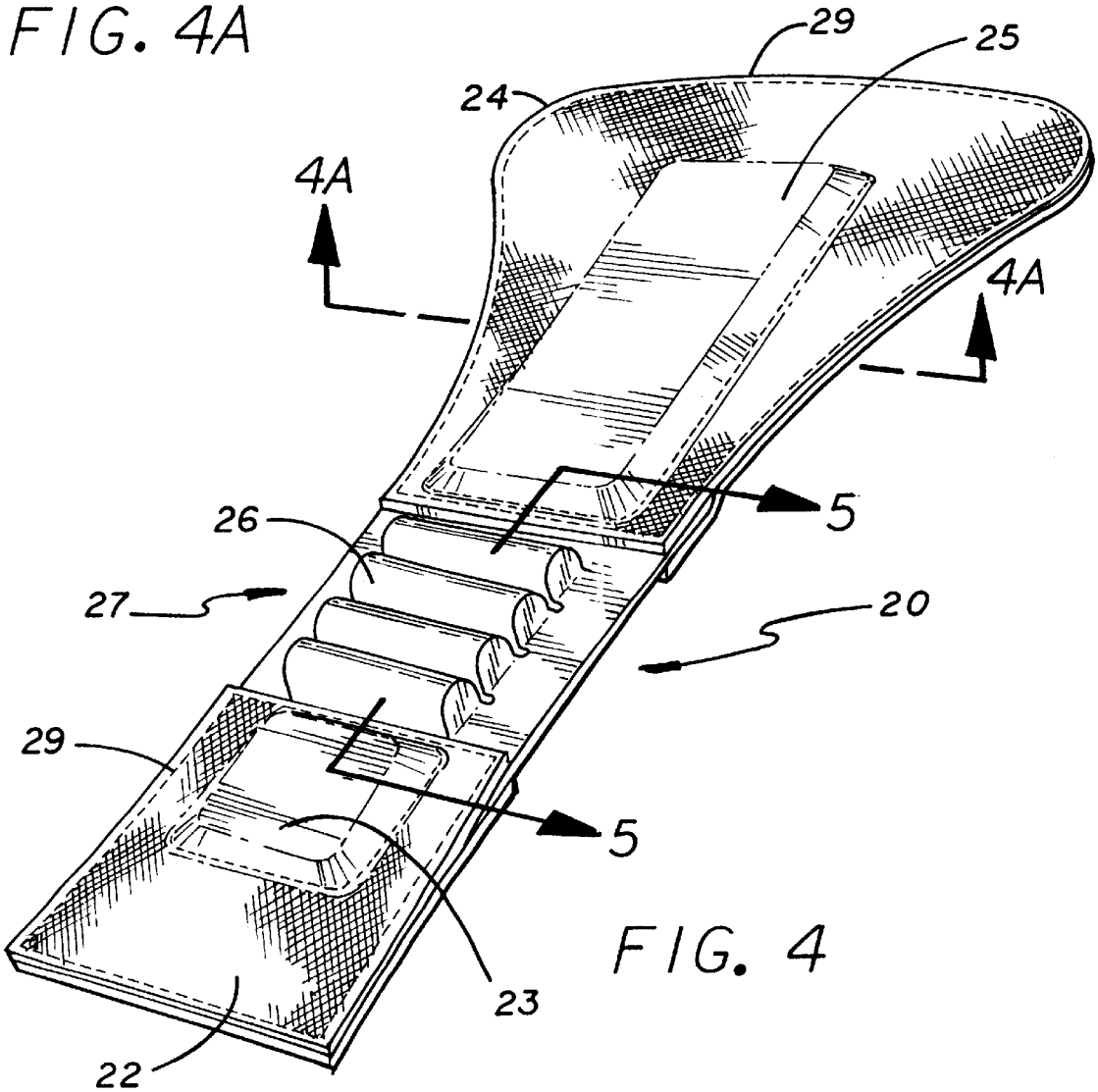
FIG. 4 is a perspective view of a tongue and flexible tongue panel therein.
Figure 6:
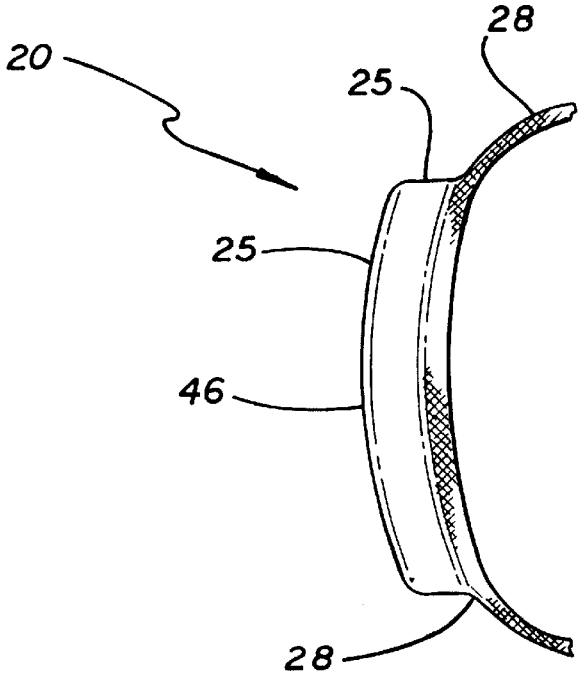
FIG. 6 is a top plan view of the flexible tongue panel of FIG. 5.

As seen in FIGS. 4 and 6 the tongue includes thin lateral edges 28 and a lower portion 22 having a raised central area 23, an upper portion 24 having a raised central area 25 and a central flexible intermediate section 26. The upper and lower portions of the tongue are usually of leather or synthetic leather for comfort and breathability and may be comprised of multiple layers as shown joined by stitching 29. The raised central areas 23, 25 may be filled with foam or felt as shown in FIG. 4A and a felt or other soft inner layer may be bonded to the tongue for cushioning. The flexible section 26, like the ankle cuff section 40, is instead made of moldable synthetic plastic material which may be designed and shaped to provide flexure and directional flexibility characteristics of choice. Moldable elastomers such as urethane, polyester or other similar materials which can be constructed with controlled flexibility to maintain adequate lateral as well as forward and aft ankle flex while reducing resulting distortion to the lower foot confining section 10 and upper leg confining section 30 of the boot to prevent rubbing and discomfort to the skater. Preferably, the cuff panel 40 and intermediate tongue panel 26 of flexible material are configured with molded groups of substantially parallel ridges 46 and valleys 48 to enable flexing of the cuff and tongue panel 26 in the desired directions without fatigue failure. For example, fore and aft flex greater than lateral flex may be desired and the amount of desired flex may be varied depending on the skater's weight, strength, type of skating for which the boot is intended or personal preferences. Since most flex takes place in the molded sections of the boot which entirely replace the leather or simulated leather sections, the boot sections are less subject to being distorted during use and the fit and comfort is thus preserved for a greater length of time.

Figure 5:
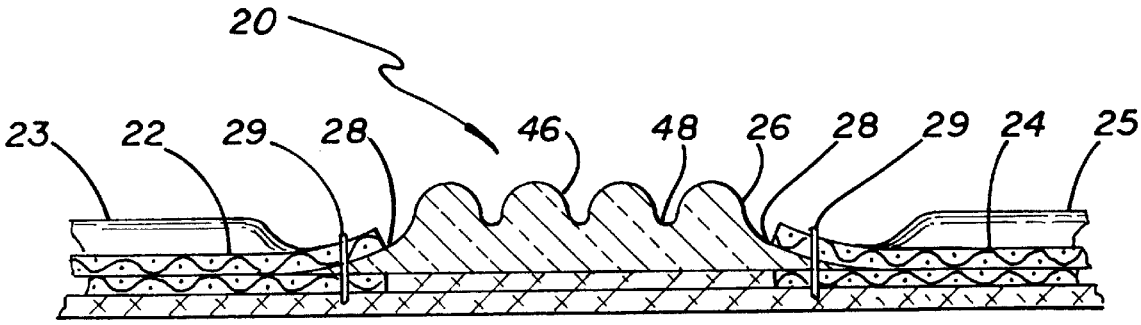
FIG. 5 is a cross section showing connection of the tongue sections to each other.

FIG. 5 shows a cross-section of the tongue 20 which, in its lower portion 22 and upper portion 24, is constructed of one or more layers of leather or simulated leather or equivalent material whereby the laterally extending thin edges 28 extend alongside the ridges and valleys 46, 48 in the tongue panel 26 and above and below the ridges and valleys 46, 48 at the upper and lower ends thereof and also alongside the raised areas 23, 25 in the lower and upper portions 22, 24 of the tongue. The tongue panel 26 thus has a generally relatively thick longitudinally extending central region 27 comprised of ridges and valleys similar to the ridges and valleys 46, 48 of the flexible cuff section 40.

Figure 2:
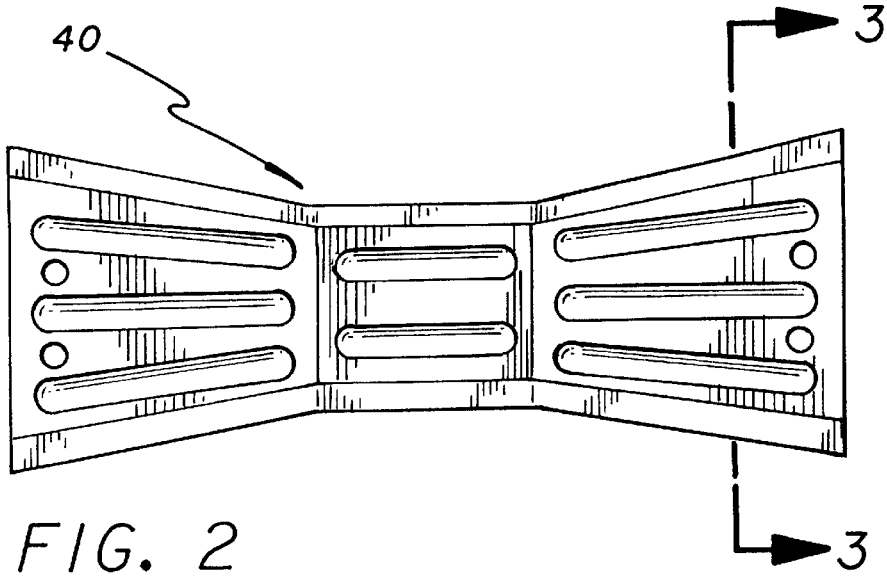
FIG. 2 is a plan view of a flexible ankle cuff panel in a bow tie configuration used in the boot of FIG. 1.
Figure 3:
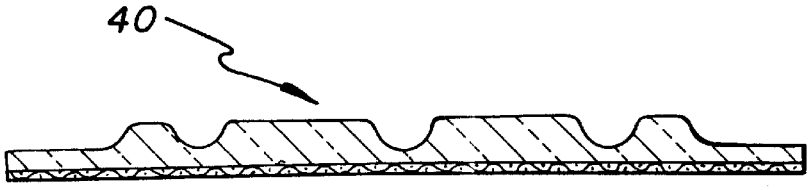
FIG. 3 is a cross section taken at line 3—3 of the flexible panel of FIG. 2.

Comparing FIGS. 2 and 7, it is seen that the flexible cuff section may take different configurations. In FIG. 2 the cuff section takes the form of a generally bow tie shaped member having three separate groups of generally parallel ridges and valleys therein with eyelets 42 at the lateral edges. In FIG. 7, the ankle cuff section 40 is of generally cylindrical configuration with the ridges and valleys 46, 48 extending therearound. The ridges and valleys may be configured as shown in FIG. 2 or in other configurations to enhance the flexibility of the cuff section 40. Accordingly, it is not intended that the invention be strictly limited to the particular configurations or groups ridges and valleys shown in the drawings since many modifications are possible without departing from the particular teachings of the invention.

Typically the boot has a rigid sole 18 which is sewn or otherwise affixed to the leather, simulated leather or similar foot confining section 10 which is more flexible then the sole 18. The sole 18 is of sufficient rigidity to receive a skate attachment such as an ice skate blade, a roller blade or roller skate attachments.

As seen in FIGS. 6 and 8, the laterally extending thin edges 28 of the tongue are configured to underlie the laterally adjacent edges 44 of the flexible cuff section 40 and the laterally adjacent edges of the lower and upper boot sections 10, 30 whereas the raised areas 23, 25 and the relatively thick central region 27 of the tongue abut the lateral edges 44 of the flexible cuff section. This prevents migration of the tongue 20 from the desired frontal position to the left or to the right to the skater's foot during skating maneuvers while eliminating annoying thick overlapping at the margins of the tongue and resulting pressure points on the skater's ankle. This keying action effectively eliminates the annoying side-slip and resulting discomfort known as lace bight caused by tongue migration during skating.

As shown in the drawings, particularly FIG. 8, the flexible cuff section 40 is aligned with the flexible tongue section 26 when the boot is laced such that the ankle is essentially completely encircled by a flexible cuff. Additionally, unlike typical prior art boots which use continuous reinforcing bands for the lace eyelets, the reinforcing bands 16 and 36 in the lower and upper sections of the boot respectively are discontinuous in the region of the flexible encircling cuff section 40. This discontinuity in the lace bands eliminates wrinkling of the reinforcing lace bands in reaction to flexing of the boot.

It is also contemplated that the flexible cuff section 40 can, with appropriate design, comprise an elastomeric energy storage and release device to assist the skater in imparting additional force near the end of the skating stroke. Various synthetic materials or combinations thereof can be used with or without directionally oriented reinforcing fibers to mold the flexible cuff and tongue sections with-the specific designed in directional flexibility and amount of flexibility as desired. Resilient moldable materials for the cuff section 40 also can be selected to enhance energy storage and recovery well within the skill of technicians familiar with the molding of elastomeric materials.

Persons skilled in the art will appreciate that various modifications of the invention can be made from the above described preferred embodiment and that the scope of protection is limited only by the following claims.

What is claimed is:

1. A boot comprising an upper section and a separate lower foot confining section formed of leather or synthetic leather material of flexibility which permits said lower section to conform to the shape of a foot and a tongue connected to said foot confining section; an ankle cuff section having a lower terminal edge joined to an upper terminal edge of said lower section around the ankle area to substantially avoid relative motion between the connected edges of said lower section and said cuff section at the rear of the boot and joined to a lower terminal edge of said upper section and spacing said lower section from said upper section; said ankle cuff section being constructed of synthetic material of equal or greater flexibility than said lower and said upper sections of said boot.

2. The boot of claim 1, further comprising a pair of spaced rows of lace eyelets at facing edges of said lower and upper boot sections proximate said tongue, said ankle cuff section having facing edges with lace eyelets therein aligned with said rows of eyelets in said lower and upper boot sections.

3. The boot of claim 2, wherein said tongue has spaced upper and lower portions of said leather or synthetic leather material and a flexible portion joined to each of said upper and lower portions, said flexible portion being of synthetic material of equal or greater flexibility than said lower and said upper portions of said tongue.

4. The boot of claim 3, wherein said tongue has a relatively thick central region and relatively thin longitudinal edges which underlie said facing edges to minimize migration of said tongue from desired frontal position.

5. The boot of claim 4, further comprising spaced eyelet reinforcing bands in which said rows of eyelets are positioned, said bands including separate sections affixed to said facing edges of said lower and upper boot sections and to said facing edges of said ankle cuff section overlying said relatively thin longitudinal edges of said tongue.

6. The boot of claim 3, wherein said cuff section and said flexible tongue portion are comprised substantially of elastomeric material.

7. The boot of claim 6, wherein said cuff section is comprised of a plurality of ridges and valleys of polyurethane elastomer extending around said boot to said tongue.

8. The boot of claim 7, wherein said ridges and said valleys extending around said cuff section are arranged in groups with non-intersecting ridges and valleys in each group.

9. The boot of claim 8, wherein said cuff section is substantially of bow tie configuration.

10. The boot of claim 7, wherein said lower section is comprised of a sole and a foot confining section which is more flexible than said sole.

11. The boot of claim 10, wherein said foot confining section is hand formed on a last.

12. A skate boot comprising a lower section including a sole for receiving a skate attachment and a relatively soft foot confining section of leather or synthetic leather material capable of conforming to the shape of a foot; a tongue having a lower portion connected to said foot confining section, a central portion connected to said lower portion and an upper portion connected to said central portion; an upper leg section; an ankle cuff section joined to said upper section and having a lower edge joined to an upper edge of said foot confining section in a manner which substantially prevents relative motion between the connected edges of said foot confining section and said ankle cuff section at connected portions of said edges including connected portions of said edges at the rear of the boot; said ankle cuff section spacing said upper section from said foot confining section; said central tongue portion comprising a flexible tongue section adjacent said ankle cuff section; said ankle cuff section being of equal or greater flexibility than said lower and said upper sections of said boot.

13. The skate boot of claim 12, wherein said ankle cuff section and said flexible tongue section are comprised substantially of elastomeric material.

14. The skate boot of claim 13, wherein said cuff section is comprised of a plurality of ridges and valleys of polyurethane elastomer extending around the ankle section of said boot.

15. The skate boot of claim 14, wherein groups of said ridges and said valleys extending around said cuff section are non-intersecting.

16. The skate boot of claim 15, wherein said elastomer is capable of storing energy when flexed and releasing to significantly affect a skater's performance.

17. The skate boot of claim 16, wherein said attachment comprises an ice skate blade affixed to said sole.

18. The skate boot of claim 16, wherein said attachment comprises a roller blade affixed to said sole.

19. The skate boot of claim 12, further comprising a pair of spaced rows of lace eyelets at facing edges of said lower and upper boot sections proximate said tongue, said ankle cuff section having facing edges with lace eyelets therein aligned with said rows of eyelets in said lower and upper boot sections.

20. The skate boot of claim 19, wherein said tongue has a longitudinally extending thick central region and relatively thin longitudinal edges which underlie said facing edges to minimize migration of said tongue from desired frontal position.

21. The skate boot of claim 20, wherein said thin longitudinal edges of said tongue underlie said facing edges of said ankle cuff section.

22. The skate boot of claim 21, wherein said thin longitudinal edges of said tongue also underlie said facing edges of said lower and upper boot sections.

23. The skate boot of claim 22, further comprising a pair of spaced eyelet reinforcing bands in which said rows of eyelets are positioned, said bands including separate sections affixed to facing edges of said lower and upper boot sections and to facing edges of said ankle cuff section proximate said tongue.

* * * * *